United States Patent [19]

Ohmi et al.

[11] Patent Number: 4,584,975

[45] Date of Patent: Apr. 29, 1986

[54] OIL DRAIN ARRANGEMENT FOR INTERNAL COMBUSTION ENGINE

[75] Inventors: Masatoshi Ohmi; Junkichi Amano, both of Iwata, Japan

[73] Assignee: Yamaha Hatsudoki Kabushiki Kaisha, Japan

[21] Appl. No.: 734,477

[22] Filed: May 15, 1985

[30] Foreign Application Priority Data

May 16, 1984 [JP] Japan ..... 59-70365[U]

[51] Int. Cl.[4] ..... F01L 11/04

[52] U.S. Cl. ..... 123/90.38; 123/90.33; 123/193 H; 123/195 C; 123/196 R; 184/6.5

[58] Field of Search ..... 123/198 DA, 90.37, 90.38, 123/196 R, 196 S, 196 M, 195 C, 198 E, 193 H, 90.33; 184/6.4, 6.5, 6.27

[56] References Cited

U.S. PATENT DOCUMENTS

| | | | |
|---|---|---|---|
| 1,647,849 | 11/1927 | Woolson | 123/90.33 |
| 3,672,338 | 6/1972 | Yamanouchi | 123/90.38 |
| 3,841,280 | 10/1974 | Lussier | 123/195 C |
| 4,206,739 | 6/1980 | Schrag | 123/196 S |
| 4,345,552 | 8/1982 | Kasting et al. | 123/90.38 |
| 4,359,018 | 11/1982 | Wade | 123/90.33 |
| 4,376,425 | 3/1983 | Cantrell | 123/90.38 |
| 4,471,731 | 9/1984 | Kasting et al. | 123/90.38 |

*Primary Examiner*—Ira S. Lazarus

*Attorney, Agent, or Firm*—Ernest A. Beutler

[57] ABSTRACT

An internal combustion engine having an improved cylinder head draining arrangement for accumulating oil that may leak from the cylinder head and its cover in use or which may flow from the cylinder head when the cover is removed for surfacing. The drain trough is inclined and has a drain opening at its lowermost end in which a removable closure plug is positioned.

7 Claims, 6 Drawing Figures

OIL DRAIN ARRANGEMENT FOR INTERNAL COMBUSTION ENGINE

BACKGROUND OF THE INVENTION

This invention relates to an oil drain arrangement for internal combustion engines and more particularly to an improved arrangement for handling oil leakage in an internal combustion engine.

With overhead valve internal combustion engines, the valves are supported within the cylinder head and some form of actuating mechanism is carried by the cylinder head for operating the valves. If the engine is of the overhead camshaft type, this operating mechanism will include the camshafts. Because of the high loading on the valve train, it is the normal practice to provide copious amounts of lubrication for the valve actuating mechanism and compoents of the valves themselves. Thus, there is a large degree of oil present in the cylinder head of an internal combustion engine having overhead valves at all times. Normally, it is the practice to provide some cover that encloses the valve and valve actuating mechanism of the cylinder head. There is, of course, a seal provided between the cover and the cylinder head. Frequently, however, it is necessary to remove the cover for servicing. Oftentimes, the level of the lubricant in the cylinder head is above the sealing surface and when the cover is removed lubricant is likely to spill from the cylinder head onto other components of the engine. This not only causes an unsightly appearance but can cause smoking and other disturbing consequences when the engine is subsequently run. These problems are particularly acute when the cylinder head and engine are installed in the vehicle in an inclined manner. Such inclination can result with V type engines or with inline engines that are not mounted in a vertical position.

It is, therefore, a principal object of this invention to provide an improved drainage arrangement for internal combustion engines.

It is a further object of this invention to provide an improved system for an internal combustion engine wherein leakage oil is contained and may not run down onto other components of the engine.

It is a yet further object of this invention to provide an oil draining system for draining and collecting leakage oil from an engine and specifically from its cylinder head area.

SUMMARY OF THE INVENTION

This invention is adapted to be embodied in an internal combustion engine having a cylinder head supporting a plurality of valves and a valve actuating mechanism. A cover is affixed to the cylinder head and encloses the valves and the valve actuating mechanism. A sealing surface is formed between the cylinder head and the cover. In accordance with the invention, a drain gutter is formed in the cylinder head outside of the sealing surface and adapted to collect and retain lubricant leaking from within the cover and past the sealing surface.

DETAILED DESCRIPTION OF THE PREFERRED EMBODIMENT

Figure 1:
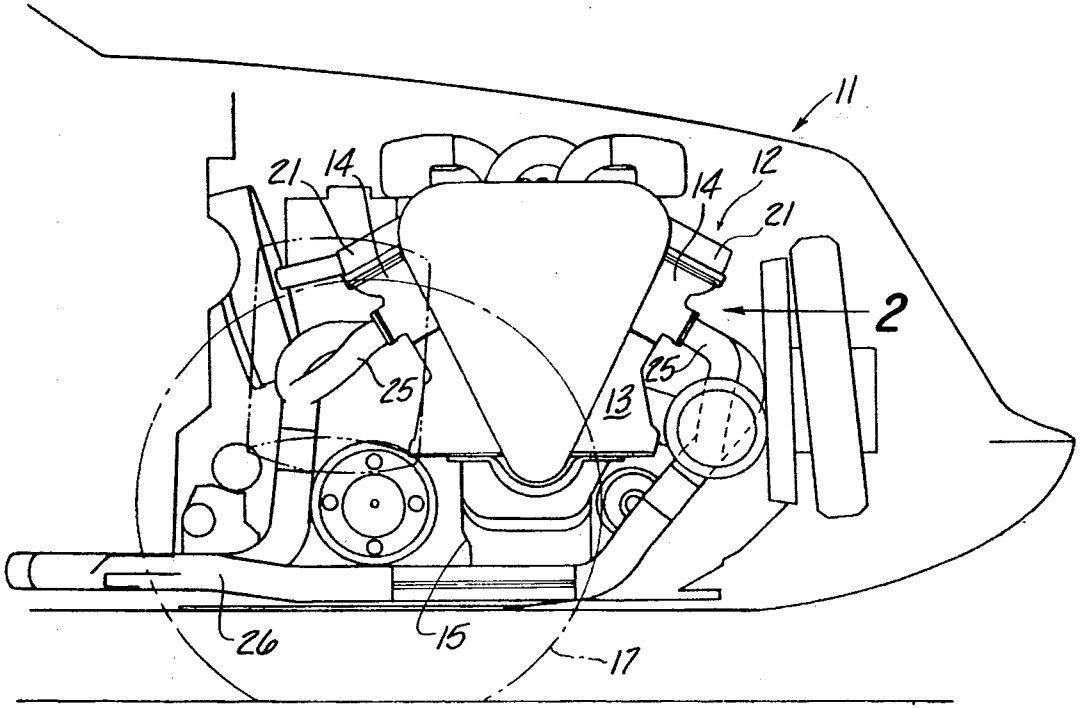
FIG. 1 is a side elevational view of a portion of a motor vehicle incorporating an internal combustion engine constructed in accordance with an embodiment of the invention, with portions broken away to more clearly show the construction.
Figure 2:
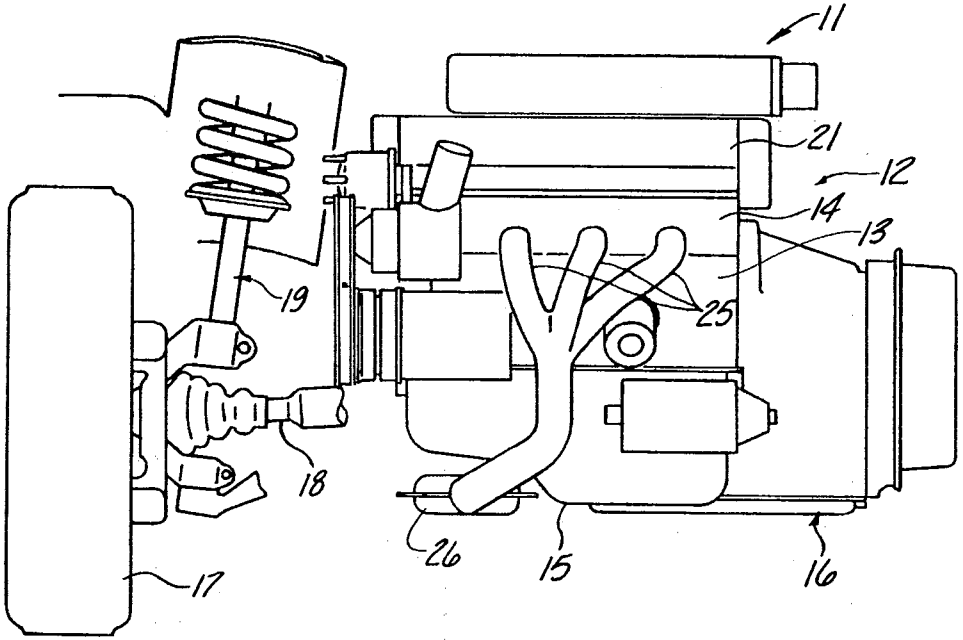
FIG. 2 is a view taken generally in the direction of the arrow 2 in FIG. 1.

Referring first to FIGS. 1 and 2, a portion of a motor vehicle powered by an internal combustion engine constructed in accordance with an embodiment of the invention is identified generally by the reference numeral 11. The vehicle 11 is depicted as being of the front wheel drive, transverse engine type. Although the invention has particular utility in connection with such engine installations, it should be readily apparent that the invention may be utilized in conjunction with other automotive applications or, for that matter, may be applied to other uses for internal combustion engines.

The vehicle 11 is, as has been noted, powered by an internal combustion engine which is identified generally by the reference numeral 12. In accordance with the preferred embodiment of the invention, the engine 12 is of the V type and includes a cylinder block 13 having a pair of angularly disposed cylinder banks each of which carries a respective cylinder head 14 at its upper end. In the illustrated embodiment, the engine 12 is of the V6 type. It is to be understood, however, that the invention may be practiced in connection with engines having other types of cylinder configurations. A crankcase 15 is affixed to the underside of the cylinder block 13 and contains the lubricating oil for the engine 12, as is well known.

The engine 13 is positioned within the vehicle 11 with its crankshaft rotating about a transversely extending axis. A suitable transfer mechanism and change speed transmission, indicated generally by the reference numeral 16, is provided for taking the power output from the engine 11 and transmitting it to the front wheels 17 through a suitable drive arrangement including half shafts 18 (only one of which appears in the drawings). The front wheels 17 are suspended by means of a pillar type suspension 19 in an appropriate manner.

Figure 3:
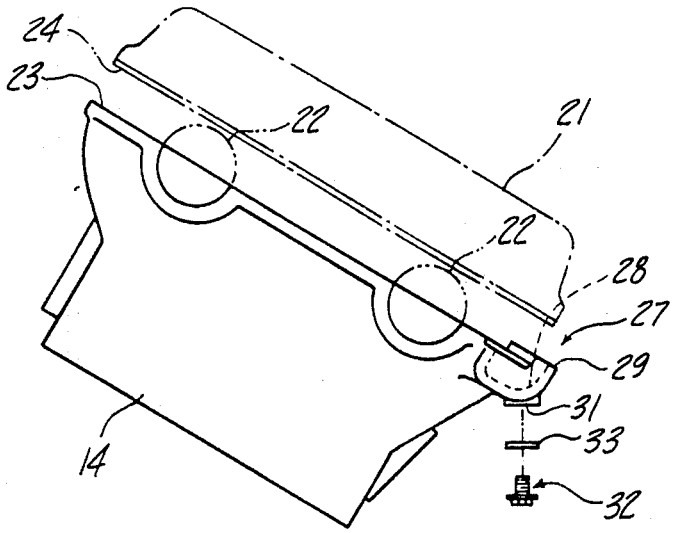
FIG. 3 is a partially exploded phantom view of one of the cylinder heads of the engine.

In accordance with the illustrated embodiment, the engine 12 is of the double overhead camshaft type that employs an intake camshaft and an exhaust camshaft for each cylinder bank. These chamshafts are journaled in the cylinder head 14 in a known manner and the valves and camshaft mechanism are enclosed by means of cam covers 21 that are affixed to each of the cylinder heads 14. The specific valve operating mechanism forms no part of the invention but it may be of the type shown generally in copending Application Ser. No. 634,795, filed July 20, 1984 in the names of Masatoshi Ohmi et al, entitled "Intake Means Of Internal Combustion Engine" and assigned to the assignee of this application. The rotational axis of the camshafts, which appear in FIG. 3 wherein the camshafts are identified by the reference numerals 22, coincides with a sealing surface 23 of the cylinder head 14 which mates with a corresponding sealing surface 24 of the cam cover 21. Of course, a gasket may be interposed between the sealing surfaces 23 and 24, as is well known in this art.

Exhaust manifolds 25 are affixed to the respective cylinder heads 14 and deliver the exhaust gases to an appropriate exhaust system 26.

Referring now primarily to FIGS. 3 through 6, the arrangement for handling oil leakage will be described. This arrangement includes a drain gutter assembly, indicated generally by the reference numeral 27 and which is dispoed on the lower side of each cylinder head assembly 14. This drain gutter assembly 27 includes a drain trough 28 that extends from one end of each cylinder head 14 to the other and which is defined by an upstanding lip 29 formed at the outer periphery of each cylinder head 14. The gutter or trough 28 and lip 29 are disposed outwardly beyond the sealing surface 23 of the cylinder head and the corresponding sealing surface 24 of the cam cover 21.

Figure 5:
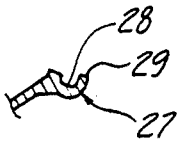
FIG. 5 is a cross-sectional view taken along the line 5—5 of FIG. 4.
Figure 6:
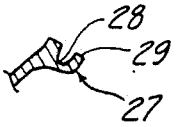
FIG. 6 is a cross-sectional view taken along the line 6—6 of FIG. 4.
Figure 4:
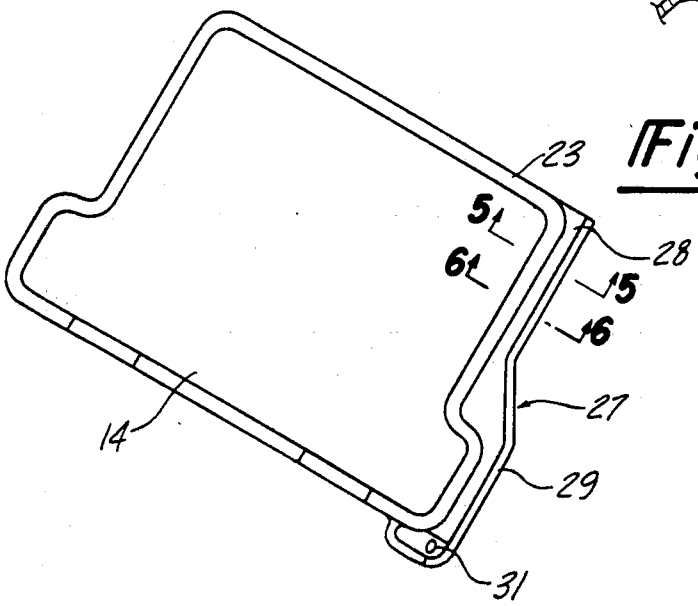
FIG. 4 is a top plan view of the cylinder head.

As may be seen from the cross-sectional views, FIGS. 5 and 6, the depth of the trough 28 increases from one end of the cylinder head toward the other so that any oil which leaks beyond the sealing surfaces 23 and 24 will be drained forwardly and will not be permitted to run off of the cylinder head surface. At the forward end of the cylinder head, a drain opening 31 may be formed that is closed by a closure plug 32 and sealing gasket 33. Thus, oil that has accumulated in the gutter or drain trough 28 can easily be drained into an appropriate container by removing the plug 32. When the engine is being serviced and the camshaft covers 21 are removed, any residual oil in the cylinder heads 14 will flow into the drains 27 and not down on to the exhaust mainfolds 25 or other portions of the engine. Thus, the leakage of oil during this condition will be protected and the engine will be maintained in a clean state.

Although an embodiment of the invention has been illustrated and described, various changes and modifications may be made without departing from the spirit and scope of the invention, as defined by the appended claims.

We claim:

1. In an internal combustion engine having a cylinder head supporting a plurality of valves and a valve actuating mechanism, a cover affixed to said cylinder head and enclosing said valves and said valve actuating mechanism, and a sealing surface formed between said cylinder head and said cover, the improvement comprising a drain gutter formed in said cylinder head outside of said sealing surface and adapted to collect and retain lubricant passing from beyond said sealing surface.

2. In an internal combustion engine as set forth in claim 1 wherein the drain gutter comprises an inclined trough having an increasing depth from one end of the cylinder head to the other.

3. In an internal combustion engine as set forth in claim 1 wherein the valve actuating mechanism comprises at least one camshaft rotatably journaled by the cylinder head about an axis lying substantially in the plane of the sealing surfaces.

4. In an internal combustion engine as set forth in claim 1 wherein the cylinder head is disposed at an inclined angle and the drain gutter is formed on the lower side thereof.

5. In an internal combustion engine as set forth in claim 4 wherein the engine is of the V type and each of the cylinder heads is provided with a drain gutter as defined.

6. In an internal combustion engine as set forth in claim 5 wherein each of the drain gutters is inclined to have an increasing depth from one end of the cylinder head to the other.

7. In an internal combustion engine as set forth in claim 6 further including drain means positioned at the deepest end of the drain trough for draining lubricant thereform.

* * * * *